US005990789A

United States Patent [19]

Berman et al.

[11] Patent Number: 5,990,789

[45] Date of Patent: Nov. 23, 1999

[54] SYSTEM AND METHOD FOR PREVENTING SMOKE AND FIRE DAMAGE TO PEOPLE AND EQUIPMENT IN A CLEAN ROOM AREA FROM A FIRE

[75] Inventors: Michael Jay Berman, West Linn, Oreg.; Joseph B. Barsky, San Jose, Calif.

[73] Assignee: LSI Logic Corporation, Milpitas, Calif.

[21] Appl. No.: 08/899,629

[22] Filed: Jul. 24, 1997

[51] Int. Cl.[6] ..... G08B 29/00

[52] U.S. Cl. ..... 340/506; 340/524; 340/525; 340/577; 340/584; 340/628; 340/632; 109/1 R; 109/31; 109/33; 454/369; 169/19; 169/49

[58] Field of Search ..... 340/286.05, 506, 340/524, 525, 577, 578, 579, 584, 628, 629, 630, 632, 633, 634; 169/49, 54, 61, 23, 56, 60, 48, 19, 29, 37, 90; 160/1, 10, 44; 454/369; 109/1 R, 31, 33

[56] References Cited

U.S. PATENT DOCUMENTS

| | | | |
|---|---|---|---|
| 3,807,480 | 4/1974 | Smart | 160/1 |
| 3,866,687 | 2/1975 | Banner | 169/61 |
| 4,059,059 | 11/1977 | Hughes | 109/1 R |
| 4,195,288 | 3/1980 | Morton | 340/539 |
| 4,610,012 | 9/1986 | Terada et al. | 370/527 |
| 4,797,254 | 1/1989 | Seidel | 422/49 |
| 5,074,137 | 12/1991 | Harris et al. | 73/31.02 |
| 5,163,517 | 11/1992 | Kozai et al. | 169/60 |
| 5,573,066 | 11/1996 | Vaillancourt et al. | 169/49 |
| 5,782,690 | 7/1998 | Gustafson et al. | 454/369 |
| 5,833,295 | 11/1998 | Farlow, Jr. | 296/24.1 |

*Primary Examiner*—Benjamin C. Lee

[57] ABSTRACT

A method and system for preventing smoke and fire damage in a clean room within which a tool including an electrically powered element is located. The method includes the step of providing the tool with a system including a fire proof housing, a sensor, an environmental sealing mechanism, an operator panel and a controller. The fire proof housing is secured over the tool and includes a door and at least one port to the tool. The sensor monitors an environmental condition within the housing and generates a sensor signal. The environmental sealing mechanism seals the at least one port and the door to the housing in response to the control signals to render the housing environmentally sealed. The operator panel includes visual indicators responsive to actuation signals. The controller is adapted to receive and process the sensor signals and to execute a shutdown control sequence during which the control signals and the actuation signals are generated.

12 Claims, 1 Drawing Sheet

SYSTEM AND METHOD FOR PREVENTING SMOKE AND FIRE DAMAGE TO PEOPLE AND EQUIPMENT IN A CLEAN ROOM AREA FROM A FIRE

BACKGROUND OF THE INVENTION

1. Field of the Invention

The present invention relates to a system and method for preventing smoke and fire damage and, more particularly, a system and method for preventing smoke and fire damage to people and equipment in a clean room area.

2. Description of the Related Art

In modern wafer fabrication and integrated circuit manufacturing facilities, many, often dozens, of work benches or tools are located in a single clean room area. A fire in a sink, wet bench or other piece of equipment not only results in damaged equipment and potential harm to workers, but also, in a sufficiently large facility, could cause hundreds of millions of dollars in damage due to lost production. More specifically, smoke contamination from a single damaged tool can spread throughout the entire clean room area potentially rendering the entire fabrication facility unusable from that point on.

With many tools in a single clean room area, it would be desirable to be able to isolate a single piece of equipment in the event of a fire. Furthermore, it would be desirable to provide a system and method for detecting such a fire and particularly the contaminants associated therewith and for effecting an automated environmental isolation of the area immediately surrounding the fire. Such a system and method would be adapted to thereafter extinguish the fire while preventing any contaminants from spreading throughout the clean room area.

SUMMARY OF THE INVENTION

Therefore, an objective of the present invention is to provide a system and method for preventing smoke and fire damage to people and equipment in a clean room area, and particularly for wet benches, chemical delivery systems and any other equipment normally used in high value areas.

In one aspect of the present invention, a system for preventing smoke and fire damage to people and equipment in a clean room area includes a fireproof housing, a sensor, a controller, an environmental sealing mechanism and an operator panel. The fireproof housing includes a door and at least one port to a tool within the housing. Exemplary tools include wetbenches, sinks or wetstations, automated wetbenches, and chemical vapor deposition systems. The tool includes an electrically powered element. The sensor is adapted to monitor an environmental condition within the housing and to generate a sensor signal. The controller is adapted to receive and process the sensor signal in order to generate control signals including a contamination indication signal, a power disconnect control signal and a door closing control signal, and to generate actuation signals. The controller is adapted to generate the contamination indication signal when the sensor signal is indicative of a contamination condition within the housing. The controller is adapted to generate the power disconnect control signal for disconnecting power to the electrically powered elements of the tool. The controller is adapted to generate the door closing signal at a predetermined time after said contamination indication signal is generated. The environmental sealing mechanism is responsive to at least the door closing control signal and is adapted to environmentally seal the door to the housing. The operator panel includes a contamination indicator and a number of visual indicators. The contamination indicator is adapted to respond to the contamination indication signal while the visual indicators are adapted to respond to the actuation signals.

In a broader aspect of the present invention, a system for preventing smoke and fire damage includes: a fire proof housing with a door and at least one port to a tool within the housing; a sensor adapted to monitor an environmental condition within the housing and to generate a sensor signal; a mechanism responsive to control signals for environmentally sealing the at least one port and the door to the housing to render the housing environmentally sealed; and a controller adapted to receive and process the sensor signal and to generate the control signals.

In another aspect of the present invention, a method for preventing smoke and fire damage in a clean room within which a tool including an electrically powered element is located includes the step of providing the tool with a system for preventing smoke and fire damage, wherein such a system includes: a fireproof housing over the tool, the housing including a door and at least one port to the tool; a sensor adapted to monitor an environmental condition within the housing and to generate a sensor signal; a mechanism responsive to control signals for environmentally sealing the at least one port and the door to the housing to render the housing environmentally sealed; an operator panel with visual indicators responsive to actuation signals; and a controller adapted to receive and process the sensor signal and to execute a shut down control sequence during which the control signals and the actuation signals are generated.

In another aspect of the present invention the method further includes providing a sensor to generate a sensor signal indicative of a contamination condition within the housing and providing a controller adapted to execute a shut down control sequence in response to the sensor signal indicative of a contamination condition, wherein the shut down sequence generates a control signal for disconnecting power to the electrically powered element of the tool at a predetermined time after the shut down control sequence begins.

In another aspect of the present invention, the method further includes providing a system for preventing smoke and fire damage which includes a drain at a bottom portion of the housing and the method further includes the steps of opening the drain and verifying that the at least one port is closed.

In another aspect of the present invention, the method further includes providing a controller adapted to generate control signals including a door closing control signal and to provide the door closing control signal to the mechanism for environmentally sealing the door to the housing after the at least one port is closed; and providing a mechanism for environmentally sealing the door to the housing, the mechanism being adapted to close and seal the door to the housing upon receipt of the door closing control signal.

In another aspect of the present invention, the method further includes: providing a controller adapted to generate control signals including a fire suppression system activation signal and to generate a fire suppression system activation signal after the door is closed and sealed; and providing a fire suppression system within the housing, the fire suppression system being adapted to activate upon receipt of the fire suppression system activation signal.

In another aspect of the present invention, the method further includes: providing a controller adapted to generate control signals including an isolation valve control signal and a three-wave valve control signal; providing an isolation valve attached to the tool and a three-wave valve connected to the isolation valve, to a water storage container and to a bulk chemical storage container, the isolation valve being adapted to regulate a flow of fluids therethrough in response to the isolation valve control signal, the three-wave valve being adapted to selectively provide a fluidic connection between the isolation valve and either the water storage container or the bulk chemical storage container in response to the three-wave valve control signal; and providing a controller adapted to execute a shut down control sequence during which the isolation valve control signal and the three-way valve control signal are selectively generated, at a predetermined time after the fire suppression system is activated, to provide a fluidic connection between the isolation valve and the water storage container for a sufficient amount of time to direct a predetermined quantity of water to the tool from the water storage container after which time the isolation valve control signal is generated to close the isolation valve.

In another aspect of the present invention, the method further includes the steps of: closing a ventilation conduit connected to one of the ports; closing the drain; disconnecting the ventilation conduit, the drain conduit and the three-wave valve from the system; and removing the system from the clean room.

DESCRIPTION OF THE DRAWINGS

Other objects, features and advantages of the invention will become readily apparent upon reference to the following detailed description when considered in conjunction with the accompanying drawings, in which like reference numerals designate like parts throughout the figures thereof, and wherein.

DETAILED DESCRIPTION OF THE PREFERRED EMBODIMENTS

Figure 1:
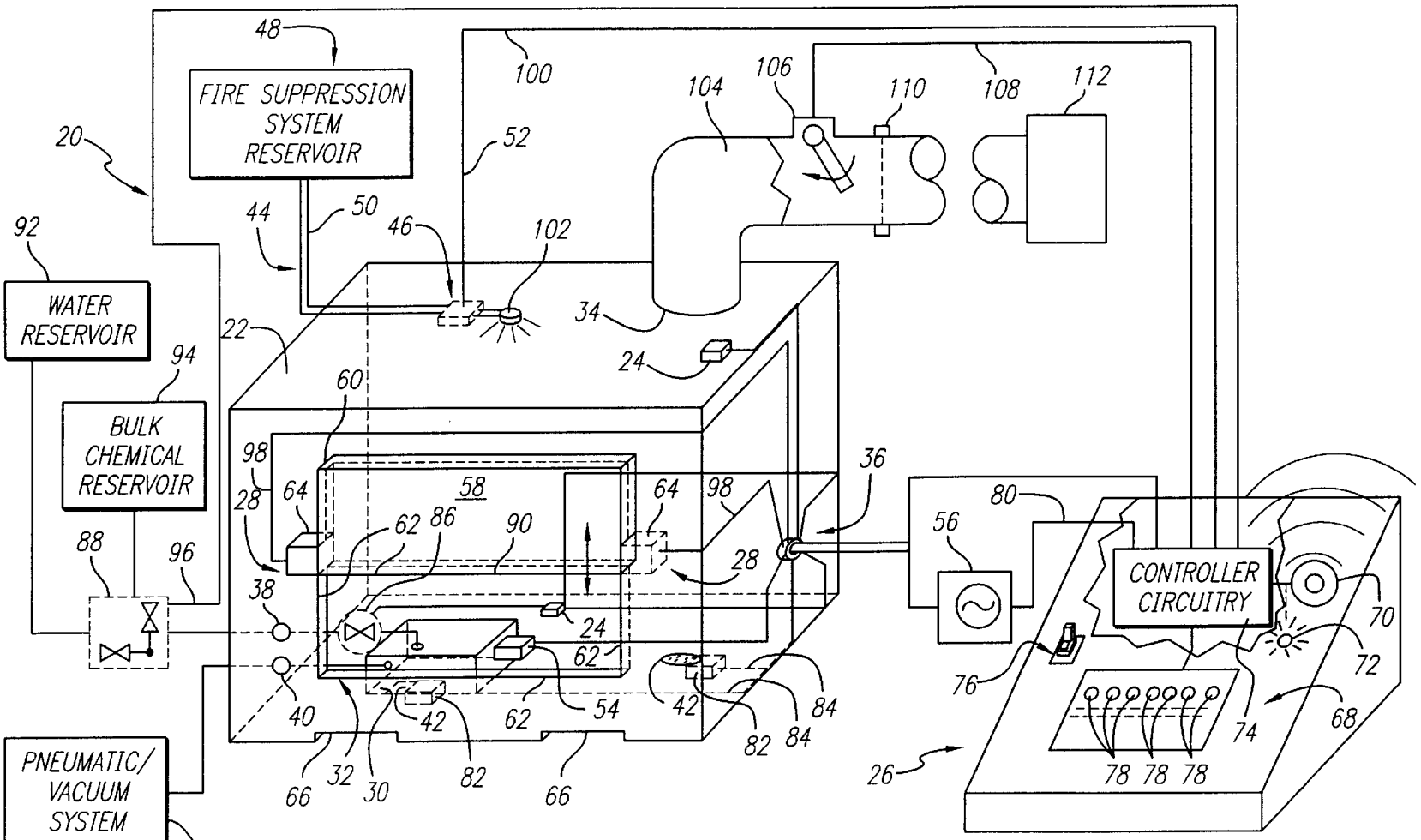
FIG. 1 illustrates an exemplary preferred embodiment of a system for preventing smoke and fire damage to people and equipment in a clean room area from a fire according to the present invention.

Referring to FIG. 1, a system 20 for preventing smoke and fire damage is shown in an exemplary preferred embodiment. The system 20 is particularly useful for preventing smoke and fire damage to people and equipment in a clean room area or in any other high value area such as a large wafer fabrication facility including multiple wet benches, tools or the like. The exemplary system 20 includes a housing 22, at least one sensor 24, a controller subsystem 26 and an environmental sealing mechanism 28. The housing 22 comprises a fire proof material such as 18 gauge stainless steel with a one hour fire rating. A tool 30 is positioned within the housing 22 as shown. A number of ports are provided in the housing 22 to facilitate the routing of electrical connections and various conduits into the housing 22. The ports include a door opening 32, a ventilation port 34, an electrical wiring port 36, a fluid port 38, a pneumatic/vacuum system port 40 and at least one drain port 42. The system 20 shown in FIG. 1 also includes a fire suppression system 44 and a pneumatic/vacuum system 41. In the illustrated embodiment, the system 20 additionally includes a fire suppression system port 46. The illustrated fire suppression system 44 includes an externally located fire suppression system reservoir 48, conduit 50 and control wiring 52. The conduit 50 and control wiring 52 are routed through the fire suppression system port 46 as shown. An alternative embodiment of the system 20 positions the entire fire suppression system 44 within the housing 22 and routes the control wiring 52 through the electrical wiring port 36 to the controller subsystem 26. As may be readily appreciated, the particular arrangement and combination of ports shown in FIG. 1 can be modified depending upon the nature of the particular tool 30 within the housing 22 and upon other considerations related to the configuration of any particular clean room area.

Tools within a clean room typically include an electrically powered element 54 which is often responsible for or instrumental in the introduction of contaminants into the clean room environment when a fire occurs. Exemplary tools include wetbenchs, sinks or wetstations, automated wetbenchs, and chemical vapor deposition systems. As shown in FIG. 1, an electrical power source 56 is electrically connected via the electrical wiring port 36 to the electrically powered element 54. A key aspect of the present invention is that the controller subsystem 26 monitors the environmental condition within the housing 22 and effects a shutdown sequence when a contamination condition is detected. Generally, the controller subsystem 26 generates a sequence of control signals which automatically affect removal of power from the electrically powered element 54, an environmentally sealing of the housing 22, and activation of the fire suppression system 44. Before a preferred method for preventing smoke and fire damage in a clean room is discussed in detail, additional system elements are identified below.

The housing 22 includes a door 58 shown in a raised or opened position within a door guide 60. The door opening 32 in the housing 22 is lined or fitted with an environmental sealing material 62 on all four sides. Motor controlled mechanisms 64 comprise conventional geared, pneumatic or other mechanisms which, in conjunction with the door guide 60, raise the door to the opened position and, in response to a door closing control signal, lower the door 58 to a closed position where the door 58 forms an environmental seal with the environmental sealing material 62. As with the motor controlled mechanisms 64, the door guides 60 are conventional. The illustrated door manipulating mechanism can be modified to suit different door configurations, for example, a hinged door or multiple doors. As with the housing 22, the door 58 preferably comprises a fireproof material such as stainless steel. However, the door 58 may alternatively comprise a transparent, fire proof material, if desired. The environmental sealing material 62 is conventional, and, should be selected and configured in an appropriate manner to withstand anticipated temperatures of fires within the housing 22 while still maintaining an environmental seal between the door 58 and the housing 22 and for a sufficiently long period of time to completely execute the shutdown sequence and thereafter safely remove the housing 22 from the clean room.

The housing 22 additionally includes grooves 66 formed at the bottom thereof. The grooves 66 are formed and appropriately sized to receive a forklift or the like for the purpose of raising the housing 22 from the ground and removing it from the clean room, preferably after a fire within the housing 22 has been completely extinguished.

The controller subsystem 26 includes an operator panel 68 upon which a plurality of indicators and user input mechanisms are located. A preferred operator panel 68 includes an audible contamination indicator 70 comprising, for example, a loud speaker or other acoustic transducer. The preferred operator panel 68 also includes a visible contamination indicator 72 comprising, for example, an incandescent light, light emitting diode, or the like. The controller subsystem 26 includes a controller embodied within controller circuitry 74. The controller is programmed or otherwise configured to execute the aforementioned shutdown control sequence when a contamination condition is detected within the housing 22. The controller is electrically connected to the audible and visible contamination indicator 70, 72, a user override input mechanism 76 and a sequentially arranged plurality of visual indicators 78.

Generally, the controller 74 is adapted to receive and process a sensor signal generated by the sensor 24 and to generate control signals and actuation signals. A preferred sensor 24 comprises an ultra-violet/infrared (UV/IR) sensor positioned, for example, near the tool 30 or the ventilation port 34. Such a sensor is readily able to detect a change in the environmental condition within the housing 22 indicative of a fire and a contamination condition resulting therefrom. The controller circuitry 74 is preferably programmed with a predetermined delay (e.g., 3 seconds) during which a signal from the sensor 24 indicating a fire or contamination condition is verified to avoid an accidental indication of fire or contamination caused by, for example, hot wafers. After the program embodied in the controller 74 has verified that a fire or a contamination condition is present within the housing 22, the controller 74 generates a contamination indication signal which is provided to one or both of the audible and visible contamination indicators 70, 72. The controller 74 is programmed to provide a predetermined amount of time, e.g., 3 seconds, to allow an operator to actuate the override switch 76 to prevent the controller 74 from beginning execution of the shutdown control sequence in the event that the operator is able to determine that the sensor 24 is malfunctioning or has generated a sensor signal indicative of a fire or contamination when in fact there is no fire or contamination condition within the housing 22. When the operator elects not to actuate the override user input mechanism 76 within a predetermined amount of time after the controller 74 receives the sensor signal indicative of a fire or contamination condition within the housing 22, the controller 74 begins execution of the shutdown control sequence by generating a control signal for disconnecting power to the electrically powered elements 54 at a predetermined time after the shutdown control sequence begins. The controller 74 effects the aforementioned power disconnecting function by providing an appropriate control signal to the electrical power source 56 via control line 80.

In a preferred system 20, the drain ports 42 include drain shutting/opening mechanisms 82 which are electrically connected to the controller 74 via control lines 84 which are routed through the electrical wiring port 36. The drain shutting/opening mechanisms 82 are conventional and can be located beneath, within or inside the housing 22 as desired. The preferred shutdown control sequence sends control signals along lines 84 to open all of the drains 42 after power is removed from the electrically powered element 54. The drains 42, when opened, are environmentally sealed and connected to a drainage system (not shown) which prevents the escape of contaminants from the drainage system into the clean room area.

The system 20 additionally includes an isolation valve 86 mounted on the tool 30. The isolation valve 86 is connected to a three-way valve 88 through the fluid port 38. The isolation valve 86 is adapted to regulate a flow of fluids from the three-way valve 88 in response to an isolation valve control signal provided at control line 90. The three-way valve 88 is connected to a water storage container or reservoir 92 and a bulk chemical storage container or reservoir 94. The three-way valve 88 is adapted to selectively provide a fluidic connection between the isolation valve 86 and either the water storage container 92 or the bulk chemical storage container 94 in response to a three-way valve control signal provided via control line 96.

In an exemplary shutdown control sequence, the operator verifies that the ports are closed after the drains 42 have been opened. Alternatively, the system 20 can be configured such that there is no need for such an operator verification. Next, the controller 74 generates a door closing control signal which is provided to the motor controlled mechanisms 64 via control lines 98. In response to these signals, the environmental sealing mechanism 28 closes and seals the door 58 to the housing 22 as described previously.

During each stage of the shutdown control sequence, the controller 74 generates actuation signals which are provided to the plurality of visual indicators 78 depending upon which stage of the sequence is being executed. By way of example, the first indicator 78 can be illuminated when power is removed from the electrically powered element 54, a second indicator 78 can be illuminated when the drains 42 are opened, a third indicator 78 can be illuminated when the door closing control signal is generated, etc.

In the exemplary shutdown control sequence, the controller 74 next generates a fire suppression system activation signal which is provided to the fire suppression system 44 via control line 100. The fire suppression system reservoir 48 provides $CO_2$, Halen® or Halen® replacements which are disbursed into the housing 22 via a dispensing nozzle 102 in response to the fire suppression system activation signal. It is additionally contemplated that other fire suppression materials may be dispensed from the reservoir 48.

The isolation valve 86 preferably comprises a one hour fire rated stainless steel fitting which is coated with Teflon on the inside. The next step of the exemplary shutdown control sequence is implemented by the controller 74 which is programmed to generate an isolation valve control signal and a three-way valve control signal in a selective manner at a predetermined time after the fire suppression system 44 is activated, to provide a fluidic connection between the isolation valve 86 and the water storage container 92 to direct a predetermined quantity of water to the tool 30 from the water storage container 92 for a sufficient amount of time, after which time the isolation valve control signal is generated to close the isolation valve 86. The isolation valve 86 may alternatively be positioned at the fluid port 38 and may further include a quick disconnect mechanism. Such a mechanism advantageously allows systems external to the housing 22 to be readily disconnected therefrom prior to the time the housing 22 is physically removed from the clean room area. As may be readily appreciated, quick disconnects may be employed wherever conduits, lines or ports of any kind are attached to the housing 22. Furthermore, the shutdown control sequence can be modified to generate the isolation valve control signal and the three-way valve control signal in a variety of ways with the common goal being to avoid leakage of potentially toxic chemicals from the bulk chemical reservoir 94.

The exemplary method additionally includes the steps of closing a ventilation conduit 104 which is shown in FIG. 1 connected to the ventilation port 34. The controller 74 generates an appropriate control signal to a damper mechanism 106 via control line 108. The system 20 may additionally include a clamping, guillotine or similar mechanism 110 for separating the ventilation conduit 104 from a ventilator 112 prior to the time when the housing 22 is removed from the clean room area.

According to the exemplary shutdown control sequence, the drains 42 are then closed. Thereafter the ventilation conduit 104, the drain 42 (or a drain conduit connected to the drain 42) and the three-way valve 88 are disconnected from the system 20 before removing the housing 22 from the clean room.

In conclusion, it is to be understood that the foregoing detailed description and the accompanying drawings illustrate the principles of the invention. However, various changes and modifications may be employed without departing from the spirit and scope of the invention. Accordingly, the present invention is not limited to the specific forms shown in the drawings and described in detail hereinabove.

What is claimed is:

1. A system for preventing smoke and fire damage to people and equipment in a clean room comprising:

a fireproof housing with a door and at least one port to a tool within said housing, the tool including an electrically powered element;

a sensor adapted to monitor contamination within said housing and to generate a sensor signal;

a controller adapted to receive and process said sensor signal, to generate control signals including a contamination indication signal, a power disconnect control signal and a door closing control signal, and to generate actuation signals, said controller being adapted to generate said contamination indication signal when said sensor signal is indicative of a contamination condition within said housing, said controller being adapted to generate said power disconnect control signal for disconnecting power to the electrically powered element, said controller being adapted to generate said door closing control signal at a predetermined time after said contamination indication signal is generated;

means responsive to at least said door closing control signal for environmentally sealing said door to said housing; and an operator panel with a contamination indicator and a plurality of visual indicators, said contamination indicator being adapted to response to said contamination indication signal, said visual indicators being adapted to response to said actuation signals.

2. The system for preventing smoke and fire damage of claim 1 wherein:

said at least one port in said fireproof housing comprises a ventilation port.

3. The system for preventing smoke and fire damage of claim 1 wherein:

said at least one port in said fireproof housing comprises a port adapted to receive signal conducting materials.

4. The system for preventing smoke and fire damage of claim 1 wherein:

said at least one port in said fireproof housing comprises a port adapted for attachment to a conduit for conveying water or other fluids.

5. The system for preventing smoke and fire damage of claim 4 wherein:

said control signals include a fire suppression system activation signal;

said at least one port includes a drain port;

said system further comprising:

a fire suppression system including a reservoir containing fire suppression materials attached to a conduit, said conduit connected to said port in said housing, said fire suppression system being adapted to activate in response to said fire suppression activation signal thereby allowing said fire suppression material to flow into said housing.

6. The system for preventing smoke and fire damage of claim 4 wherein:

said control signals include an isolation valve control signal;

said at least one port includes a drain port;

said system further comprising:

a water reservoir containing water connected to said port in said housing, said water reservoir being adapted to activate in response to said isolation valve control signal thereby allowing said water to flow into said housing.

7. The system for preventing smoke and fire damage of claim 1 wherein:

said at least one port in said fireproof housing comprises a pneumatic or vacuum port.

8. The system for preventing smoke and fire damage of claim 1 wherein said operator panel further comprises:

a user input mechanism adapted to provide an override signal to said controller to override said sensor signal.

9. The system for preventing smoke and fire damage of claim 1 wherein said fireproof housing is portable.

10. A system for preventing smoke and fire damage comprising:

a fireproof housing with a door and at least one port to a tool within said housing said at least one port including a drain port, a water port, and a fire suppression system port;

a sensor adapted to monitor contamination within said housing and to generate a sensor signal;

a controller adapted to receive and process said sensor signal and to generate control signals, said control signals including a contamination indication signal, a power disconnect control signal, a drain port open control signal, a door closing control signal, a fire suppression system activation signal, and an isolation valve control signal, said controller being adapted to generate said contamination indication signal when said sensor signal is indicative of a contamination condition within said housing, said controller being adapted to generate said power disconnect control signal for disconnecting power to said tool after a predetermined time after generation of said contamination indication signal, said controller being adapted to generate said drain port open control signal for opening said drain port after generation of said power disconnect control signal, said controller being adapted to generate said door closing control signal after generation of said drain port open control signal, said controller being adapted to generate said fire suppression system activation signal thereby disposing a fire suppression material into said housing after generation of said door closing signal, and said controller being adapted to generate an isolation valve control signal for activation after a predetermined time after generation of said fire suppression system activation signal;

means responsive to said door closing control signal for environmentally sealing said door to said housing to render said housing environmentally sealed;

a fire suppression system including a reservoir containing fire suppression materials attached to a conduit, said conduit connected to said fire suppression system port in said housing, said fire suppression system being adapted to activate in response to said fire suppression activation signal thereby allowing said fire suppression material to flow into said housing; and a water reservoir containing water connected to said water port in said housing, said water reservoir being adapted to activate in response to said isolation valve control signal thereby allowing said water to flow into said housing.

11. The system for preventing smoke and fire damage of claim 10 wherein said fireproof housing is portable.

12. The system for preventing smoke and fire damage of claim 10 further comprising an operator panel with a contamination indicator and a plurality of visual indicators, said contamination indicator being adapted to respond to said contamination indication signal, a first visual indicator being illuminated when said power disconnect control signal is asserted, a second visual indicator being illuminated when said drain port open control signal is asserted, and a third visual indicator being illuminated when said door closing signal is asserted.

* * * * *